United States Patent [19]

Yoshino

[11] Patent Number: 4,617,040

[45] Date of Patent: Oct. 14, 1986

[54] HIGHLY PURE NITROGEN GAS PRODUCING APPARATUS

[75] Inventor: Akira Yoshino, Osaka, Japan

[73] Assignee: Daidousanso Co., Ltd., Osaka, Japan

[21] Appl. No.: 673,748

[22] PCT Filed: Mar. 7, 1984

[86] PCT No.: PCT/JP84/00089

§ 371 Date: Nov. 6, 1984

§ 102(e) Date: Nov. 6, 1984

[87] PCT Pub. No.: WO84/03554

PCT Pub. Date: Sep. 13, 1984

[30] Foreign Application Priority Data

Mar. 8, 1983 [JP] Japan ..... 58-38050
Jan. 11, 1984 [JP] Japan ..... 59-4123

[51] Int. Cl.[4] ..... F25J 3/04
[52] U.S. Cl. ..... 62/37; 62/44
[58] Field of Search ..... 62/18, 23, 24, 21, 31, 62/32, 34, 36, 37, 42, 44

[56] References Cited

U.S. PATENT DOCUMENTS 3,210,947 10/1965 Dubs et al. ..... 62/18
3,339,370 9/1967 Streich et al. ..... 62/18
4,380,457 4/1983 Rathbone et al. ..... 62/18

*Primary Examiner*—Frank Sever
*Attorney, Agent, or Firm*—Austin R. Miller

[57] ABSTRACT

A producing apparatus of highly pure nitrogen gas which is used in electronic industry for manufacturing silicon semi-conductors. Conventional nitrogen gas producing apparatus of low temperature separation method and of PSA method are subjected to troubles frequently, the cost of the obtained product nitrogen gas is high, yet the purity is not very high. By the apparatus of this invention, the liquefied nitrogen storage means (23) is connected to rectifying column (15) through the inlet channel (24), the ultra low temperature compressed air supplied into the rectifying column (15) through the air compression means (9), removing means (12) and heat exchangers (13) (14) is cooled further by the evaporating heat of the liquefied nitrogen, the nitrogen is taken out in gas form by utilizing the difference in boiling point, and oxygen is left as liquid. The obtained nitrogen gas is combined with the gassified liquid nitrogen from the liquefied nitrogen storage means (23) and made into product nitrogen gas. Highly pure nitrogen gas can be produced at a low cost and with almost no trouble of the apparatus.

12 Claims, 9 Drawing Figures

HIGHLY PURE NITROGEN GAS PRODUCING APPARATUS

FIELD OF ART

This invention relates to a trouble-free nitrogen gas producing apparatus which can produce pure nitrogen gas at a low cost.

PRIOR ART

In electronic industry, quite a large quantity of nitrogen gas is used and very high purity is now demanded to maintain and improve accuracy of parts.

Nitrogen gas has been produced so far by low temperature separation method by which air as the raw material is compressed with a compressor, then is put into an adsorption cylinder to eliminate $CO_2$ gas and moisture content, then is cooled through heat exchange with refrigerant in a heat exchanger, then is turned into nitrogen gas product by low temperature separation in a rectifying column, and the nitrogen gas product is heated close to normal temperature through the said heat exchanger.

In many cases, however, troubles are resulted if the nitrogen gas is used as it is because of oxygen content as impurity.

To remove oxygen as impurity, the following two methods are available.

One is to add a slight quantity of hydrogen to the nitrogen gas by using Pt catalyst and to turn the oxygen into water through reaction with the hydrogen in atmosphere of about 200° C.

Another method is to put the oxygen in nitrogen gas in contact with Ni catalyst in atmosphere of about 200° C. and to eliminate oxygen through reaction of $Ni+1/2O_2—NiO$.

By either method, however, the nitrogen gas must be heated to a high temperature and be put in contact with a catalyst. It isn't possible, therefore, to incorporate the apparatus into nitrogen gas producing apparatus of ultra-low temperature system. A refining apparatus must be installed separately from the nitrogen gas producing apparatus, which makes the whole system larger.

Moreover, the first method requires a high skill for operation since the quantity of hydrogen must be controlled accurately. If the hydrogen added is not exactly in the quantity required for reaction with the oxygen impurity, the oxygen or the added hydrogen is still left as impurity.

By the second method, the cost of refining is increased by the $H_2$ gas equipment for re-generation as it is necessary to regenerate NiO produced through reaction with the oxygen impurity ($NiO+H_2—Ni+H_2O$). It has been demanded, therefore, to solve these problems.

For the nitrogen gas producing apparatus of the conventional low temperature separation type, an expansion turbine is used for cooling the refrigerant of the heat exchanger to cool down the compressed air by heat exchange, and the turbine is driven by the pressure of the gas evaporated from the liquid air accumulated in the rectifying column (nitrogen of low boiling point is taken out as gas by low temperature separation and the residual air is accumulated as oxygen rich liquid air).

Follow-up operation of changing load (changes in taken out quantity of product nitrogen gas) is difficult since the turning speed of the expansion turbine is very fast (several tens of thousand per minute). It is, therefore, difficult to change feeding quantity of liquid air to the expansion turbine exactly according to the changes in the quantity of taken out product nitrogen gas so that the compressed air is cooled to a constant temperature at all times.

As the result, the purity of the product nitrogen gas differs and nitrogen gas of low purity is produced frequently.

The expansion turbine requires high precision in the mechanical structure because of high-speed revolution, the cost is high, and the intricated mechanism is subjected to frequent troubles.

Nitrogen gas producing apparatus of PSA system which eliminates such anexpansion turbine, therefore, was developed recently. FIG. 1 shows the nitrogen gas producing apparatus of PSA system. In the drawing, (1) is the air inlet, (2) is the air compressor, (3) is the after cooler, **(3*a*) is the cooling water supply channel, and (4) is the oil-water separator. (5) is the 1st adsorption tank, (6) is the 2nd adsorption tank, and V1, V2 are air operated valves to feed the air compressed by the compressor (2) to the adsorption tank (5) or (6). V3 and V4 are vacuum valves to turn inside of the adsorption tank (5) or (6) to vacuum condition by the operation of the vacuum pump (6*a*). (6*b*) is the cooling pipe to supply cooling water to the vacuum pump (6*a*), (6*c*) is the silencer, and (6*d*) is the exhaust pipe. V5, V6, V7, and V9 are air operated valves. (7) is the product tank connected to the adsorption tanks (5)(6) through the pipe (8). (7*a*) is a product nitrogen gas take-out pipe, (7*b*) is an impurity analyzer, and (7*c*)** is a flow-meter.

By this nitrogen gas producing apparatus, air is compressed by the air compressor (2), the compressed air is cooled by the after-cooler (3) attached to the air compressor, the condensed water is removed by the separator (4), then the compressed air is supplied into the adsorption tank (5) or (6) through the air operated valve (V1) or (V2).

Two adsorption tanks (5) (6) respectively incorporate a carbon molecular sieve for oxygen adsorption, and the compressed air is supplied into the adsorption tanks (5) (6) alternatively every minute by pressure swing method.

Inside of the adsorption tank (6) or (5) to which no compressed air is supplied is kept under vacuum condition by the vacuum pump **(6*a*). In other words, the compressed air by the air compressor (2) goes into one of the two adsorption tanks (5) or (6) and the oxygen content is adsorbed and removed by the carbon molecular sieve, then the nitrogen gas is supplied into the product tank (7) through the valves (V5, V7, V9), and is taken out through the pipe (7*a*). At this time, the other adsorption tank (6) or (5) shuts off the air from the air compressor (2) since the valve (V2) closes, and the inside is drawn to vacuum by the vacuum pump (6*a*) since the valve (V4)** opens. Accordingly, the oxygen adsorbed by the carbon molecular sieve is removed to re-generate the carbon molecular sieve.

Nitrogen gas is supplied from the adsorption tanks (5) (6) alternatively to the product tank (7) to assure continuous feeding of nitrogen gas.

By the nitrogen gas producing apparatus, the characteristic of carbon molecular sieve of selective adsorption of oxygen is effectively used to produce nitrogen gas at a low cost.

However, a number of valves are necessary, the valve operation is intricated, and troubles tend to happen frequently since the two adsorption tanks (5)(6) are operated alternatively for one minute to feed compressed air and one of the tanks is subjected to vacuum drawing.

It is necessary, therefore, to provide two sets of adsorption tanks (5)(6) and to use one set as the spare.

As described above, the nitrogen producing apparatus of PSA method is also subjected to frequent troubles due to a large number of valves and requires an extra apparatus as the spare. It was therefore demanded to develop a nitrogen gas producing apparatus which can turn out highly pure nitrogen gas at a low cost.

In view of the foregoing, it is the primary object of this invention to provide a nitrogen gas producing apparatus which can produce highly pure nitrogen gas at a low cost yet without any trouble.

The invention relates to a producing apparatus of highly pure nitrogen gas comprising a means to compress the air taken from the outside, a means to remove the carbon dioxide gas and water in the compressed air compressed by the said air compression means, a means to store liquid nitrogen, a heat exchanger to cool down the said compressed air to ultra low temperature, a rectifying column to turn a part of the compressed air cooled by the said heat exchanger to ultra low temperature into liquid, to keep the liquid inside, and to keep only nitrogen in gas form, a leading channel to lead the liquefied nitrogen in the said liquefied nitrogen storage means into the said rectifying column as the source of cooling for compressed air liquefaction, and an outlet channel to take out both of the gassified liquid nitrogen after used as the cooling source and also the gassified nitrogen kept in the said rectifying column from the rectifying column as the product nitrogen gas.

For the apparatus, a liquefied nitrogen storing means is provided independently from the nitrogen gas separating system to separate nitrogen gas from air, the liquefied nitrogen in the storage means is supplied into the rectifying column belonging to the nitrogen gas separating system, the compressed air supplied into the rectifying column is cooled by using evaporation heat of the liquefied nitrogen, a part of the compressed air (oxygen content in the main) is separated by liquefaction and the nitrogen is kept in gas form, then the gas is mixed with the gassified liquid nitrogen after used as the cooling source of the rectifying column and is taken out as the product nitrogen gas. Accordingly, nitrogen gas can be obtained at a lower cost.

To be more specific, this apparatus uses liquefied nitrogen as the source of cooling and after use, the liquefied nitrogen is not discarded but is mixed with the nitrogen gas made from air to be turned into product nitrogen gas. Accordingly, the method is free from any waste of natural resources. Since the obtained product nitrogen gas is about 10 times of the consumed liquefied nitrogen, the cost of product nitrogen gas can be reduced substantially.

The use of liquefied nitrogen as the cooling source of compressed air instead of an expansion turbine enables accurate follow-up of changing load (changes in taken-out quantity of product nitrogen gas) because of delicate adjustment of feeding quantity in liquid form. The purity is, therefore, stable and highly pure nitrogen gas can be produced.

Moreover, the apparatus is subjected to almost no trouble as no expansion turbine which is susceptible to troubles is used and not many valves are required unlike PSA system.

In other words, the apparatus has almost no moving parts compared with the conventional methods and is, therefore, subjected to little trouble. There is no need to prepare an extra set of adsorption tanks as the spare as it is necessary for PSA system, which can save the equipment cost.

THE BEST MODE OF CARRYING OUT THE INVENTION

The present invention is further illustrated by the following examples.

Figure 1:
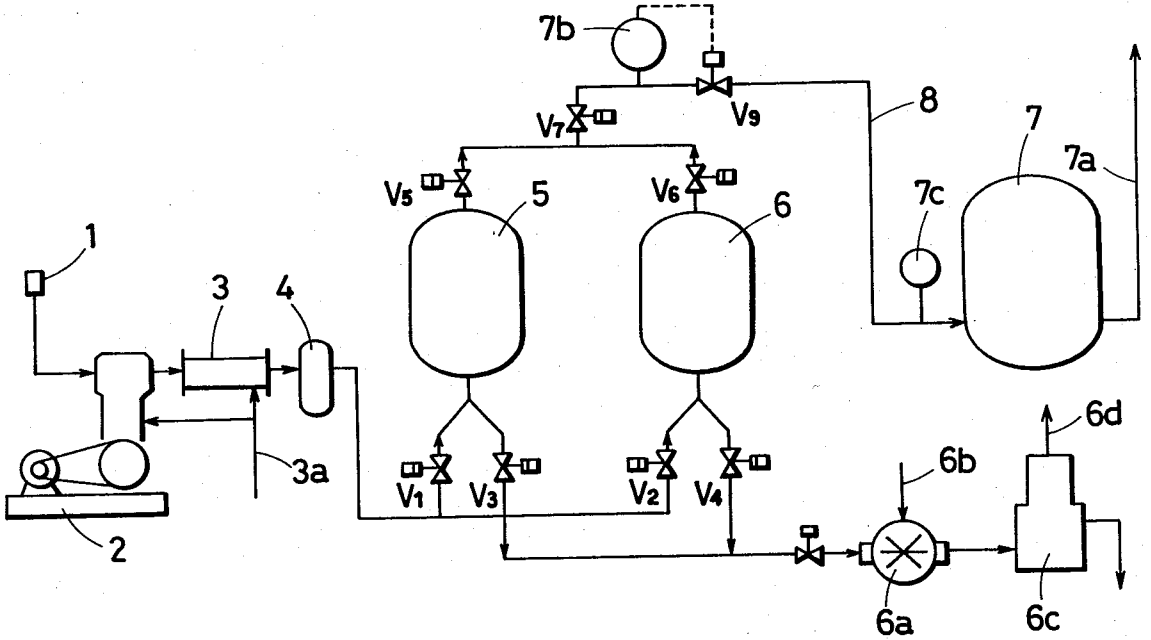
FIG. 1 PRIOR ART
FIG. 1 is an explanatory drawing of a conventional method.
Figure 2:
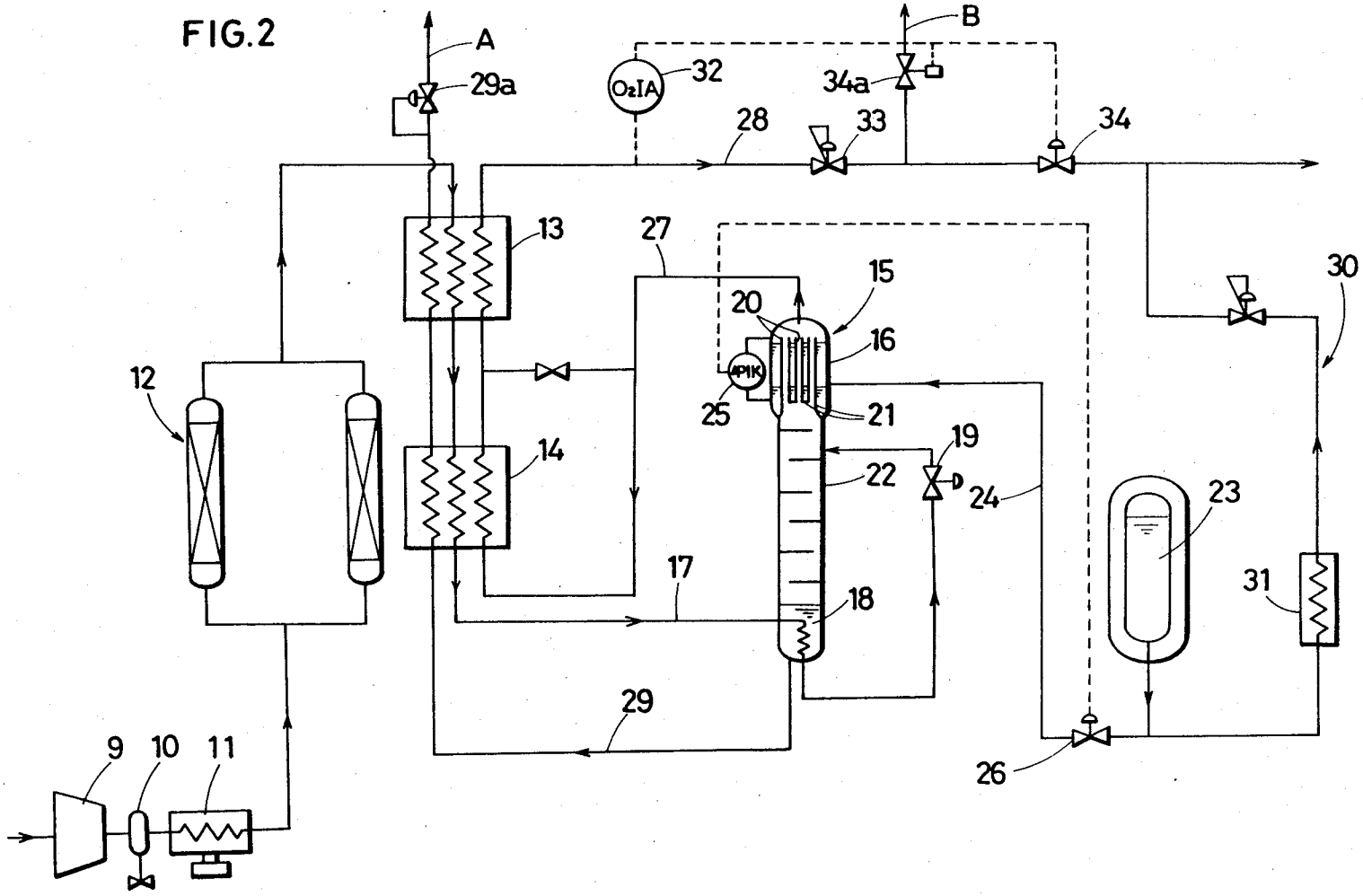
FIG. 2 is the structural drawing of an embodiment of the present invention.

FIG. 2 shows the structure of an embodiment of the present invention. In the drawing, (9) is an air compressor, (10) is a drain separator, (11) is a Freon cooler, and (12) is a pair of adsorption cylinders. The adsorption cylinders (12) are filled with molecular sieves to adsorb and remove $H_2O$ and $CO_2$ in the air compressed by the air compressor (9). (13) is the 1st heat exchanger into which the compressed air after elimination of $H_2O$ and $CO_2$ by the adsorption cylinders (12) is supplied. (14) is the 2nd heat exchanger, into which the compressed air coming through the 1st heat exchanger is supplied. (15) is a rectifying column provided with a partial condenser (16) at the top to cool the compressed air cooled down to ultra low temperature by the 1st and 2nd heat exchangers (13, 14) still further, to turn a part of the compressed air into liquid to be kept on the bottom, and to take out nitrogen only in gas form.

That is, the rectifying column (15) functions to cool the compressed air cooled down to ultra low temperature (about −170° C.) through the 1st and the 2nd heat exchangers (13, 14) further by passing through the liquefied air (18) ($N_2$ 50–70%, $O_2$ 30–50%) kept on the bottom of the rectiiying column (15) by a pipe (17), then to jet the air inside through the expansion valve (19), and oxygen is liquefied by the partial condenser (16) and nitrogen is left in gas form.

The partial condenser (16) is parted from the tower (22) by the parting plate (21) onto which a number of tubes (20) are attached. Liquefied nitrogen is supplied from the liquefied nitrogen tank (23) to the parting plate (21) through the pipe (24), the compressed air ejected into the tower (22) is guided into the tubes (20) for cooling, and oxygen (boiling point −183° C.) is liquefied and dropped to move nitrogen (boiling point −196° C.) upward as it is in gas form.

In the upper space of the partial condenser (16), the nitrogen gas made from the compressed air and the gassified nitrogen gas of the liquefied nitrogen supplied from the liquefied nitrogen tank (23) are kept in mixed condition.

In the above example, the compressed air ejected into the tower (22) of the rectifying column (15) is put in contact with liquefied oxygen in countercurrent dropping from the tubes (20). Separation of oxygen by liquefaction, therefore, is accelerated further. (25) is a level gauge to control the valve (26) according to the level of the liquefied nitrogen in the partial condenser (16) in order to maintain rectifying conditions of the inside of said rectifying column (15), and also to control supply quantity of liquefied nitrogen from the liquefied nitrogen storage tank (23). (27) is a taken-out pipe to take out the nitrogen gas staying at the upper part of the partial condenser (16) and functions to guide the nitrogen gas of ultra low temperature into the 2nd and the 1st heat exchangers (14, 13), to heat the gas to normal temperature by heat exchange with the compressed air supplied into the heat exchangers, and to feed into the main pipe (28). (29) is the pipe to feed the liquefied air stored on the bottom of the rectifying column (15) into the 2nd and the 1st heat exchangers (14, 13), and (29*a*) is the pressure holding valve. After heat exchange (cooling of compressed air) in the 2nd and the 1st heat exchangers (14, 13), the liquefied air is gassified and is discharged from the 1st heat exchanger (13) as indicated by the arrow A. (30) is the line of back-up system to feed the liquefied nitrogen in the liquefied nitrogen storage tank (23) into the main pipe (28) through evaporation by the evaporator (31) should the line of the air compression system go out of order. (32) is an impurity analyzer to analyze the purity of the product nitrogen gas fed out to the main pipe. If the purity is low, the valves (34), (34*a*) are operated to discard the product nitrogen gas to the outside as shown by the arrow B.

Nitrogen gas is produced by this apparatus through the following processes.

Air is compressed by the air compressor (9) and moisture in the compressed air is removed by the drain separator (10), then the air is cooled by the Freon cooler (11), sent to the adsorption cylinders (12) as being cooled, and $H_2O$ and $CO_2$ in the air are removed by adsorption. The compressed air after removal of $H_2O$ and $CO_2$ is supplied into the 1st and the 2nd heat exchangers (13)(14) to be cooled down to ultra low temperature, then is cooled further by the liquid air (18) stored at the bottom of the rectifying column (15) then is ejected into the tower (22) of the rectifying column (15).

Oxygen in the air is liquefied by using the difference in the boiling point between nitrogen and oxygen (oxygen −183° C.; nitrogen −196° C.), nitrogen is taken out in gas form, supplied into the 1st or the 2nd heat exchanger (13 or 14) to be heated close to normal temperature, then is taken out as nitrogen gas through the main pipe (28).

In this case, the liquefied nitrogen in the liquefied nitrogen tank (23) functions as the cooling source of the partial condenser (16) of the rectifying column (15). The liquefied nitrogen itself turns into gas and is supplied into the main pipe (28), mixed with the nitrogen gas in the air from the rectifying column (15), then is taken out as product nitrogen gas.

With this nitrogen gas producing apparatus, highly pure nitrogen gas can be obtained at very low cost because an oxygen and so forth are separated from the compressed air by liquefaction using the evaporation heat of liquefied nitrogen, and only nitrogen is taken out in gas form and mixed with liquefied nitrogen serving as the cooling source (the nitrogen itself is gassified in this stage) to be turned into product nitrogen gas.

In other words, the apparatus can produce highly pure nitrogen gas with 0.3 ppm or less of impurity oxygen by setting the rectifying column (15) at high purity since no expansion turbine is used unlike the case of conventional method.

By the conventional apparatus of low temperature separation type, the nitrogen gas obtained contains oxygen of 5 ppm as impurity and by the nitrogen gas producing apparatus of PSA method, the obtained gas contains so much oxygen as 1000 ppm. Accordingly, the apparatus, PSA type in particular, are not applicable as they are to electronic industry where highly pure nitrogen gas is required.

To be used for electronic industry, it is necessary to provide a refining apparatus separately and to remove oxygen (impurity) in nitrogen gas by adding hydrogen and by combining oxygen with hydrogen (into $H_2O$).

By these processing, however, hydrogen goes into nitrogen gas as impurity and the purity is improved only a little even if the nitrogen gas is passed through a refining apparatus. Moreover, the nitrogen gas obtained from the nitrogen gas producing apparatus of PSA type contains $CO_2$ gas of 5 to 10 ppm as impurity and another adsorption tank to remove $CO_2$ gas is necessary in addition.

With the nitrogen gas producing apparatus by the present invention, on the other hand, highly pure nitrogen gas which can be used for electronic industry as it is can be obtained. Moreover, the gas does not contain any $CO_2$ gas (eliminated by liquefaction within the producing apparatus), and there is no need to provide any adsorption tank for $CO_2$ gas separately. Simply by supplying small quantity of liquefied nitrogen, a large quantity of nitrogen gas can be obtained.

By the nitrogen gas producing apparatus of the present invention, feeding liquefied nitrogen gas of 100 $Nm^3$ from the liquefied nitrogen gas tank to the partial condenser (16) can obtain product nitrogen gas of 1000 $Nm^3$. That is, the product nitrogen gas obtained is 10 times of the liquefied nitrogen supplied.

Compared with conventional nitrogen gas producing apparatus of PSA type or of low temperature separation type, the apparatus is simple and the whole system can be lower in cost, and reliability of the apparatus is higher as not many valves or no expansion turbine are required.

Moreover, nitrogen gas can be supplied even when the line of air compression system is out of order by the line of back-up system and supply of nitrogen gas is never interrupted.

Figure 3:
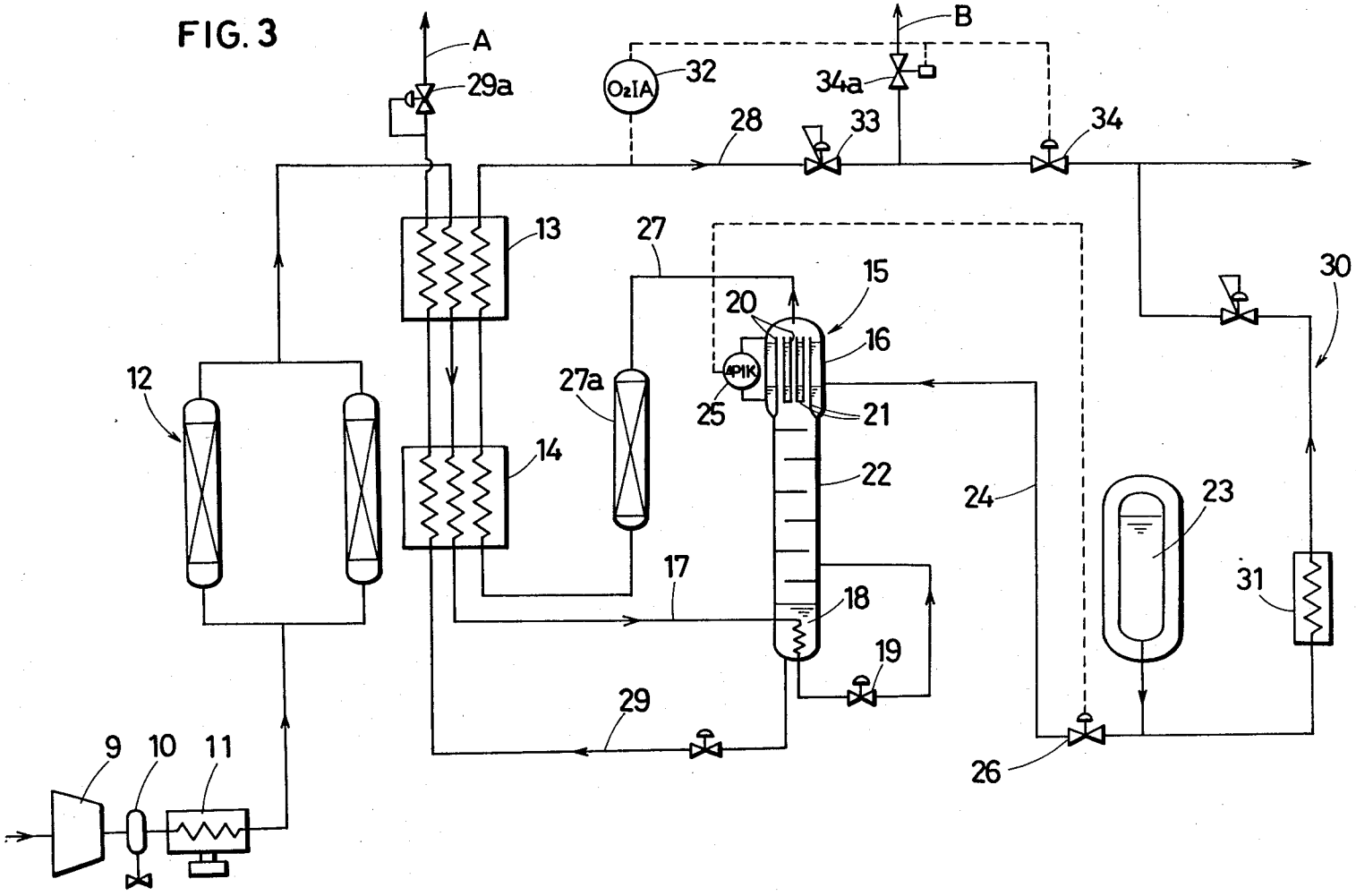
FIG. 3 is the structural drawing of another embodiment.

FIG. 3 shows the structure of another embodiment. For the highly pure gas producing apparatus, the outlet pipe (27) is provided with an oxygen adsorption cylinder (27*a*), which incorporate adsorbent that adsorbs oxygen and carbon monoxide selectively at ultra low temperature. Other parts are the same as those of the apparatus shown in FIG. 2 and the same symbols are designated to the corresponding parts to omit further description.

As the said adsorbent, synthetic zeolite 3A, 4A or 5A having pore diameter of 3 Å, 4 Å or 5 Å (molecular sieve 3A, 4A, or 5A made by Union Carbide) is used, for example. These synthetic zeolite 3A, 4A, and 5A respectively show highly selective adsorption property to oxygen and carbon monoxide (not indicated in FIG.

Figure 4:
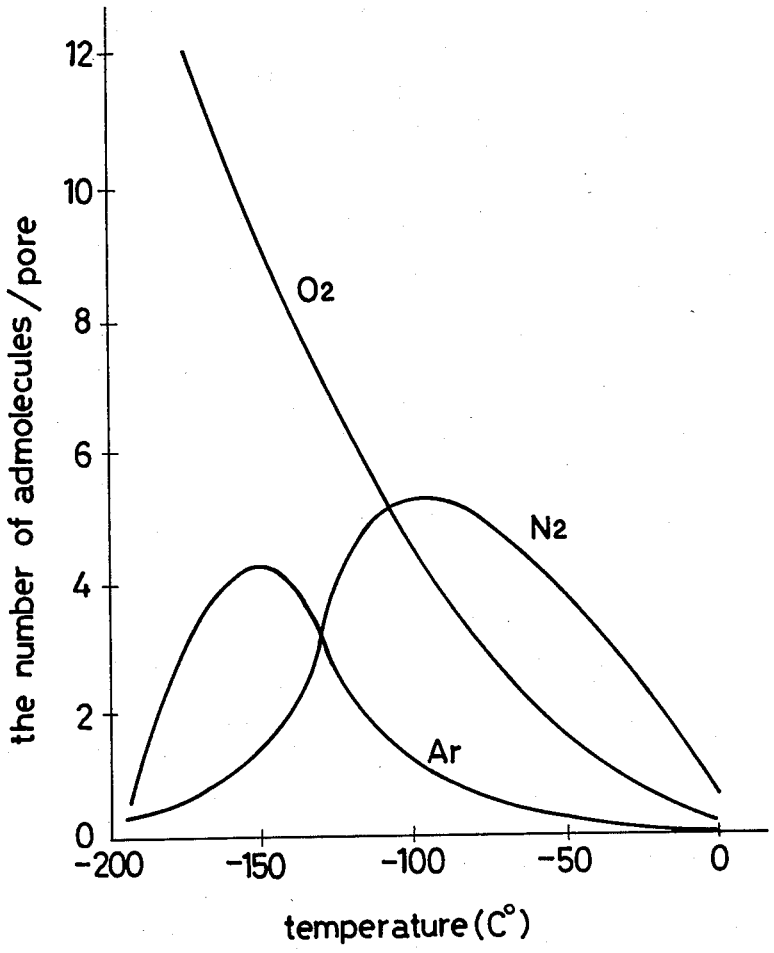
FIG. 4 is the characteristic curve of the synthetic zeolite used for the said embodiment.

4 but similar curve as $O_2$ curve in the drawing) at ultra low temperature as shown in FIG. 4.

Accordingly, the impurity in the discharged nitrogen gas from the upper space of the partial condenser (16) is eliminated and purity of the product nitrogen gas is improved further. Synthetic Zeolite 13X of Union Carbide is also used in place of the said synthetic zeolite 3A, 4A or 5A.

As a feature of this nitrogen gas producing apparatus, impurities such as oxygen and carbon monoxide are eliminated very easily by effectively using the characteristics of synthetic zeolite.

With this apparatus, the nitrogen gas produced by gassification of the liquefied nitrogen in the nitrogen tank (7) is also passed through the oxygen adsorption cylinder (11) in the same manner as the nitrogen gas obtained from compressed air. Even when the liquefied nitrogen in the nitrogen tank (7) contains impurities such as oxygen and carbon monoxide, therefore, the purity of the obtained product nitrogen gas is not lowered. In this case, the quantity of oxygen and carbon monoxide in the ultra low temperature nitrogen gas guided into the oxygen adsorption cylinder (11) has been reduced to a low level while going through the rectifying column (15). Accordingly, the quantity of oxygen and carbon monoxide adsorbed in the cylinder (11) is minimal. One unit of adsorption cylinder suffices and regeneration of zeolite once a year is sufficient.

Figure 5:
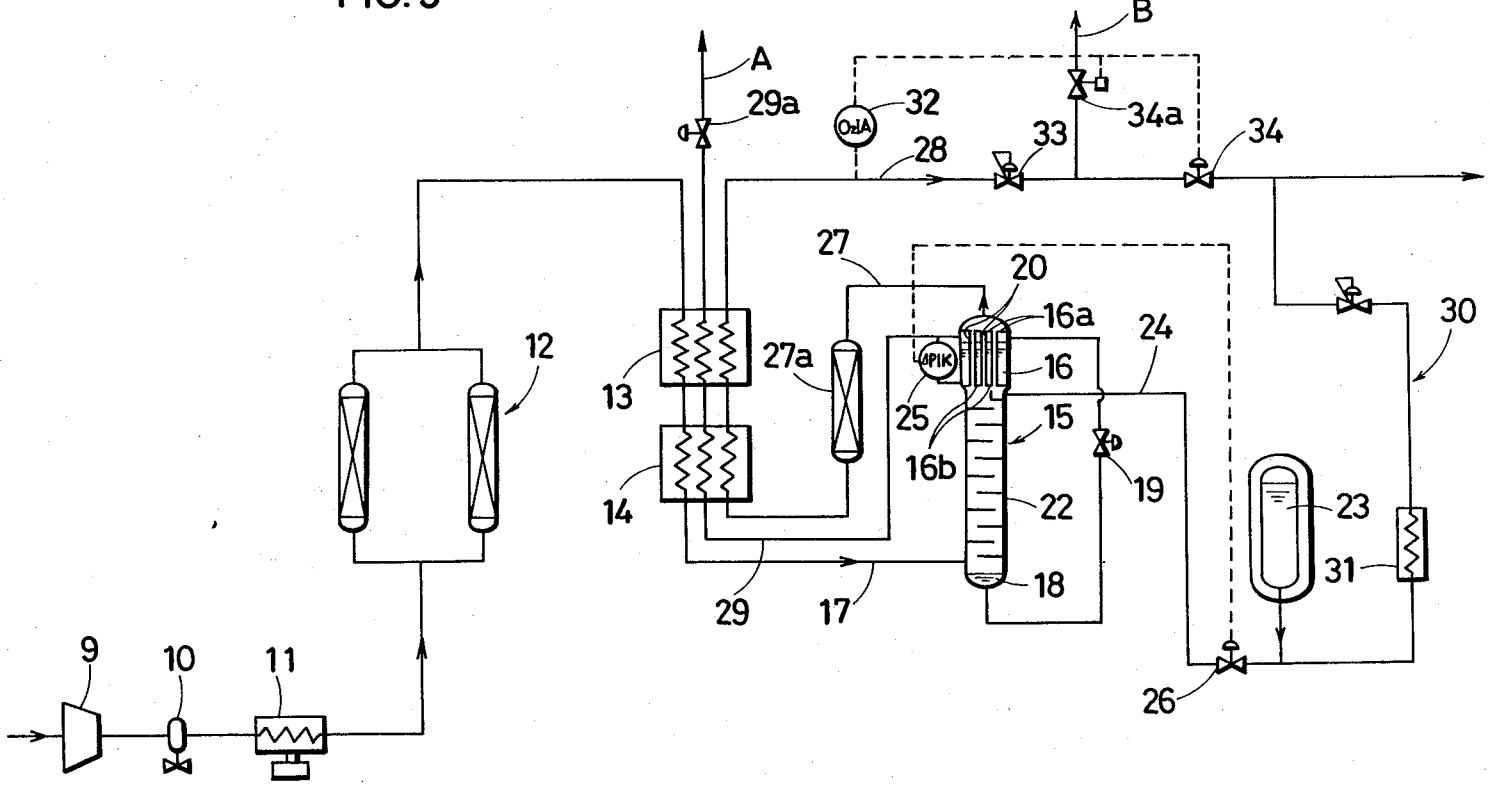
FIGS. 5 and 6 are respectively to explain other examples of the embodiment of FIG. 3.

With the apparatus shown in FIG. 3, the liquefied air accumulated on the bottom of the rectifying column (15) is ejected inside in the middle of the column (15) and the liquefied nitrogen in the liquefied nitrogen tank (7) is supplied into the partial condenser (16). It may also possible, however, to keep the liquefied air accumulated on the bottom of the rectifying column (15) inside the partial condenser (16) at the top of the tower (inside of the partial condenser is made to a sealed structure by the upper parting plate 16*a* and the lower parting plate 16*b*, and the upper space of the partial condenser 16 and the tower 22 of the rectifying column 15 are connected with two or more pipes 20), and to supply the liquefied nitrogen in the nitrogen tank (7) to the upper part of the rectifying column (15) to be flowed down to show cooling operation, as shown in FIG. 5.

Figure 6:
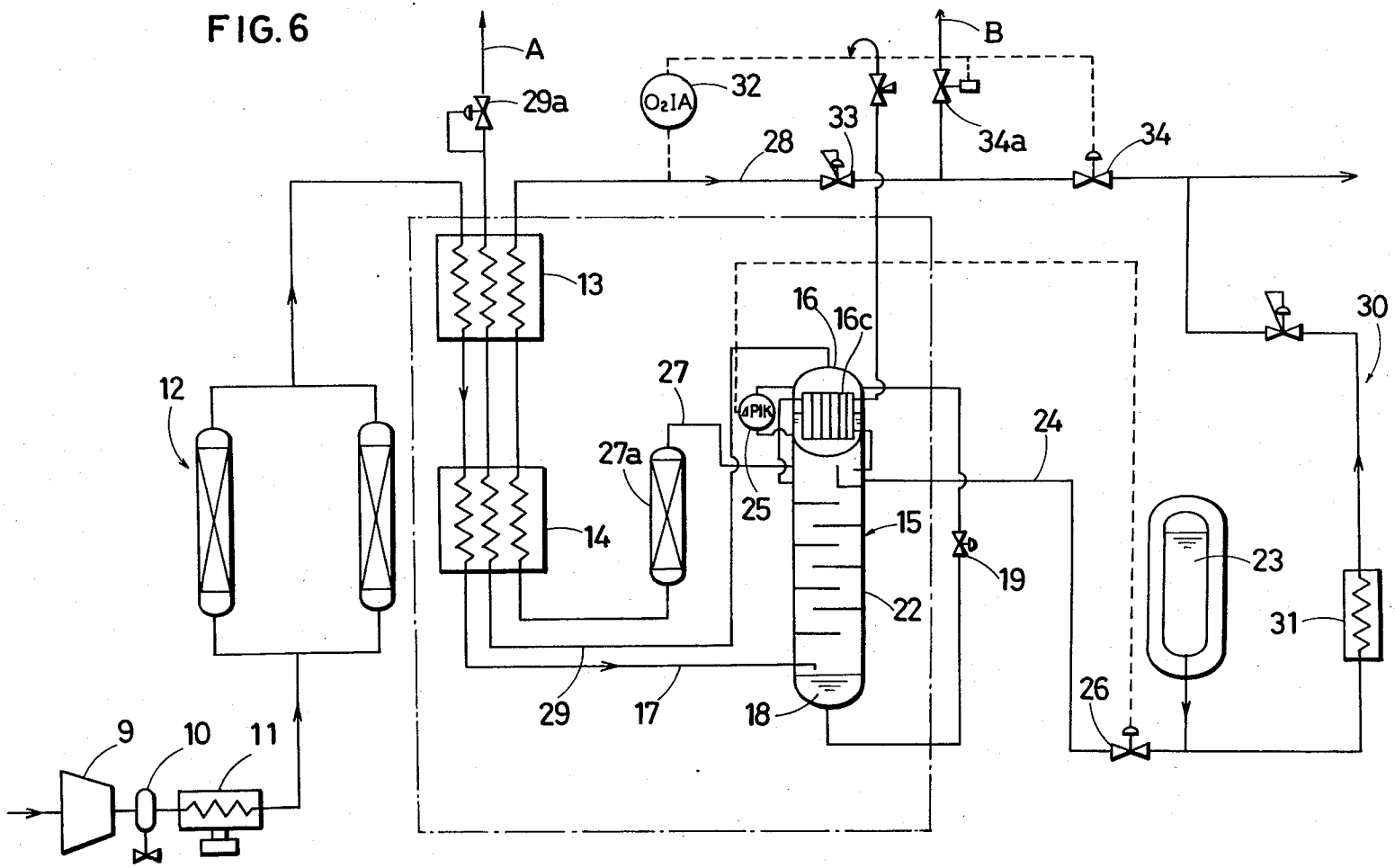

It may also possible to provide a condenser (16*c*) in the partial condenser (16), to cool the condenser (16*c*) by the liquefied air (18) at the bottom of the tower (22), to return the liquefied portion of the compressed air to the tower (22) while discharging the gassified portion into the atmosphere, and to take out the nitrogen gas from the top of the tower (22) not from the top of the partial condenser (16), as illustrated in FIG. 6.

At the upper part of the partial condenser (16), He and $H_2$ of lower boiling point (−269° C. and −253° C.) are accumulated and these get mixed if nitrogen gas is taken out from the upper part. To prevent this, it is desirable to take out nitrogen gas from the top of the tower (22) not from the top of the partial condenser (16).

In FIG. 6, the alternate long and short dash line shows a vacuum cooling box in which the heat exchangers (5, 6) and the rectifying column (15) are housed and heat-insulated by vacuum pearlite.

Figure 7:
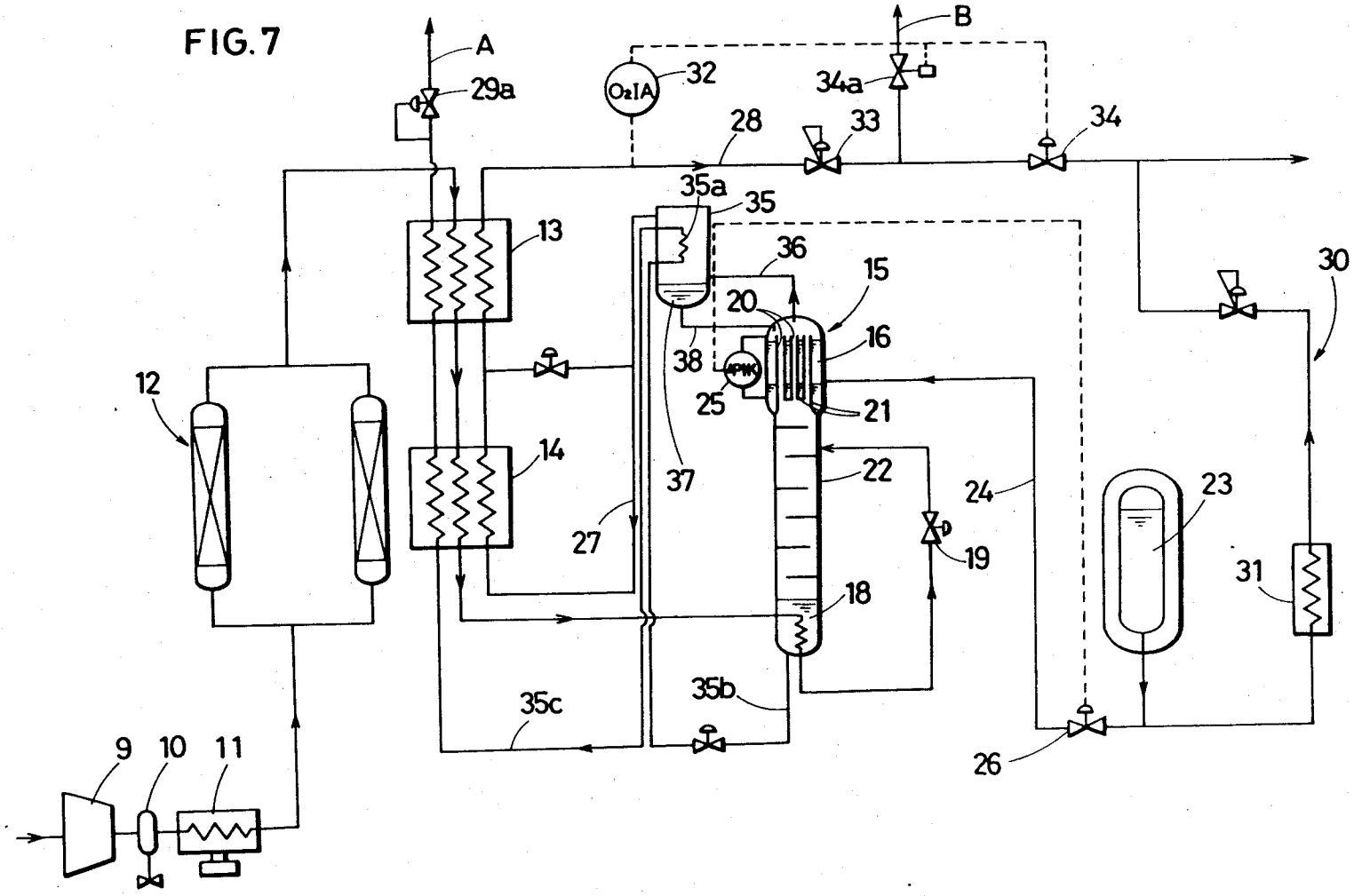
FIG. 7 is the structural drawing of still other embodiment.

FIG. 7 shows a structure of another embodiment. This nitrogen gas producing apparatus is so composed to lead the nitrogen gas accumulated in the upper space of the partial condenser (16) into the condenser (35) (the nitrogen gas separated from oxygen by liquefaction in the partial condenser 16+the gassified nitrogen of the liquefied nitrogen supplied from the liquefied nitrogen tank 7) by providing a condenser (35) at the upper outside of the rectifying column (15) and by connecting it to the upper part of the partial condenser (16) with a connection pipe (36).

The nitrogen gas is cooled by the cooling pipe (35*a*) which is connected to the bottom of the rectifying column (15) at one end (35*b*) and released to air at the other end (35*c*) through the 2nd and the 1st heat exchangers (14, 13) (the refrigerant is the liquefied air stored on the bottom of the rectifying column (15), a part of the nitrogen gas is condensed into a liquefied nitrogen gas (37). The liquefied nitrogen gas is returned to the partial condenser (16) through the return pipe (38) by the head difference, and non condensed nitrogen gas is supplied into the main pipe (28) through the 2nd and the 1st heat exchangers (14, 13).

Other parts are the same as those of the embodiment of FIG. 2 and are indicated by the same numbers.

In other words, the nitrogen gas producing apparatus can reduce supply quantity of the liquefied nitrogen from the liquefied nitrogen tank (23) because the product nitrogen gas obtained from the upper part of the partial condenser (16) is lead to the condenser (35), a part of the nitrogen gas is condensed and returned to the partial condenser (16), and is mixed with the liquefied nitrogen supplied from the liquefied nitrogen tank (23).

Accordingly, the cost of the product nitrogen gas can be lower than that of theapparatus by the embodiment of FIG. 2.

Figure 8:
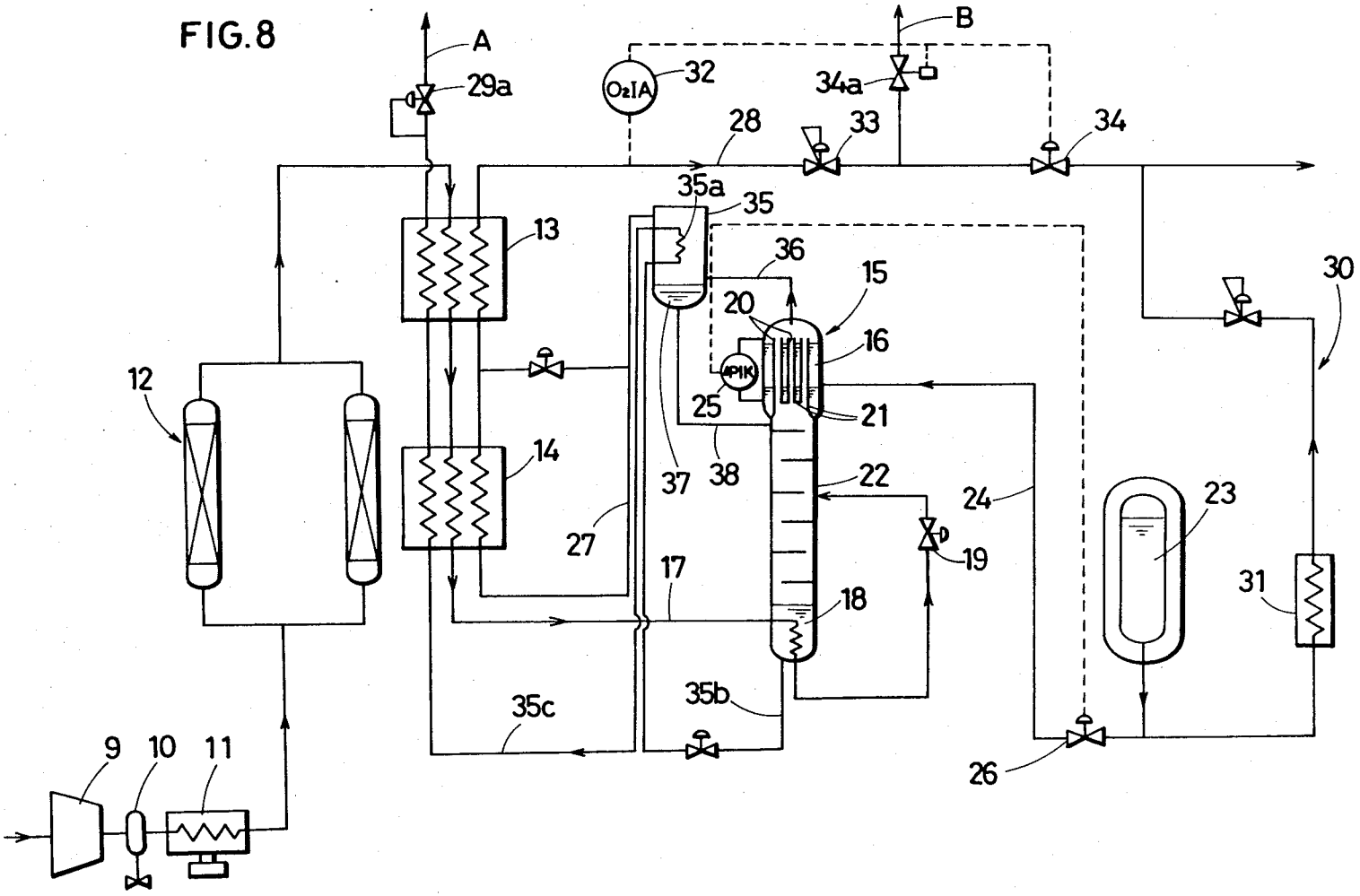
FIG. 8 and FIG. 9 are respectively to explain other examples.

For the above apparatus, the return pipe (38) is connected to the partial condenser (16) so that the liquefied nitrogen condensed and produced in the condenser (35) is returned to the partial condenser (16). It may possible, however, to return the return pipe (38) to the top of the tower (22), as shown in FIG. 8. By this arrangement, liquefied nitrogen can be saved and the effect of rectifying can also be improved.

Figure 9:
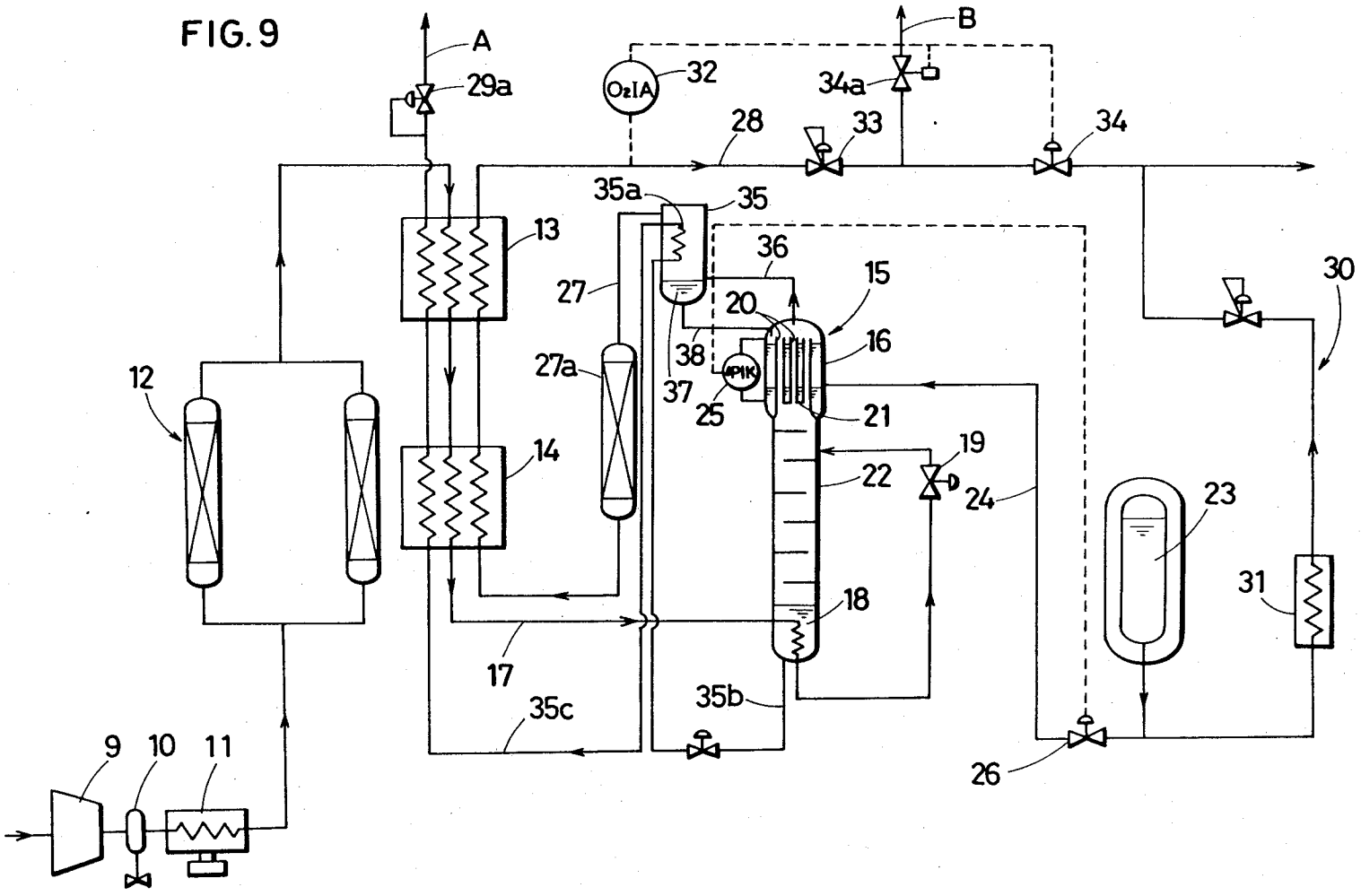

It may also possible to provide the taken-out pipe (27) between the condenser (35) and the 2nd heat exchanger (14) with the oxygen adsorption cylinder (27*a*) incorporating the adsorbent which can adsorb oxygen and carbon monoxide selectively at ultra low temperature like the apparatus in FIG. 3, as shown in FIG. 9. By this arrangement, impurity in nitrogen gas is removed by adsorption and purity of the product nitrogen gas is moreover improved.

What is claimed is:

1. In an apparatus comprising means designed for producing highly pure nitrogen gas from the rectification of air, for precluding the need for a subsequent high-temperature catalytic step and for precluding the need of purging large quantities of cooling nitrogen, the combination which comprises means effective to compress the air taken from the outside, a means to remove the carbon dioxide gas and water in the compressed air by the said air compression means, a means to store liquefied nitrogen supplied from the outside, a heat exchanger connected to cool down the compressed air passed through said removing means to ultra low temperature, a rectifying column connected to turn a part of the compressed air cooled by the heat exchanger to ultra low temperature into liquid and to keep only nitrogen in gas form, said rectifying column having evaporating means for converting said liquid nitrogen to gaseous nitrogen, a lead channel connected lead consistently the liquefied nitrogen in said liquefied nitrogen storage means into said evaporating means as a source of cooling for compressed air liquefication in place of cold generated from a gas expander, a means to control the feed rate of said liquefied nitrogen in order to maintain constant rectifying conditions in said rectifying column which is provided to said lead channel, and an outlet channel connected to combine and remove both of the gasified said liquid nitrogen after use as the cooling source and also the gasified nitrogen from the outside source, pass them through said heat exchanger and heat them by exchanging heat with said compressed air, as the product nitrogen gas.

2. A producing apparatus of highly pure nitrogen gas as set forth in claim 1, in which the rectifying column is provided with a partial condenser section and liquefied nitrogen is conducted to the said partial condenser.

3. A producing apparatus of highly pure nitrogen gas according to claim 1 or claim 2, wherein the outlet channel is provided with an adsorbing means incorporating the adsorbent which can adsorb oxygen and carbon monoxide selectively at ultra low temperature.

4. A producing apparatus of highly pure nitrogen gas as defined by claim 1, wherein the outlet channel is provided on the side of rectifying column with a condensing means to condense a part of the product nitrogen gas and to return the condensed nitrogen gas to the said rectifying column.

5. A producing apparatus of highly pure nitrogen gas in accordance with claim 4 in which the outlet channel is provided on the side of rectifying column with a condensing means to condense a part of the product nitrogen gas and to return the condensed nitrogen gas to the said rectifying column, and the part following the condensing means at the outlet channel is provided with an adsorbing means incorporating the adsorbent which adsorbs oxygen and carbon monoxide in the product nitrogen gas selectively at ultra low temperature.

6. A producing apparatus of highly pure nitrogen gas according to claim 3 or claim 5 in which the adsorbing means is an oxygen adsorption cylinder filled with synthetic zeolite of pore diameter of about 3 Å, 4 Å or 5 Å.

7. In an apparatus comprising means designed for performing a low cost method of producing high purity nitrogen gas of a quality sufficient for the electronics industry, for precluding the need for a subsequent high-temperature catalystic step and for precluding the need of purging large quantities of cooling nitrogen, the combination which comprises:

rectifying means for rectifying air at a temperature to condense oxygen from the nitrogen contained in said air, separate storage means containing liquid nitrogen as an external source, conduit means connected from said separate storage means to said rectifying means for introducing said liquid nitrogen from said external storage means into said rectifying means for heat exchanging relationship with said air being rectified in said rectifying means, evaporating means operable at low temperature for converting said liquid nitrogen from said external source to gaseous nitrogen while in said heat exchanging relationship, and conduit means extending from said evaporating means for combining the evaporated gaseous nitrogen from said external source with said nitrogen produced by evaporation from the oxygen of said air.

8. An apparatus for producing highly pure nitrogen gas as set forth in claim 7, in which said conduit means connected to said rectifying means contains valve means to control the feeding amount of said liquid nitrogen in order to maintain constant rectifying conditions in said rectifying column.

9. An apparatus for producing highly pure nitrogen gas as set forth in claim 7, in which said evaporating means comprises a partial condenser section, and said liquid nitorgen is conducted to said partial condenser.

10. An apparatus for producing highly pure nitrogen gas according to claim 7 or claim 9, wherein said conduit means extending from said evaporating means for combining gaseous nitrogen with nitrogen produced from said air is connected to adsorbing means incorporating an adsorbent which can adsorb oxygen and carbon monoxide selectively at ultra low temperatures.

11. An apparatus for producing highly pure nitrogen gas as set forth in claim 7, wherein said conduit means extending from said evaporating means for combining gaseous nitrogen with nitrogen produced from said air, is provided on the side of said evaporating means with condensing means to condense a part of the combined nitrogen gas and to return the condensed nitrogen gas to said rectifying means.

12. An apparatus for producing highly pure nitrogen gas as set forth in claim 11, wherein the conduit means following the condensing means is provided adsorbing means incorporating an adsorbent which can adsorb oxygen and carbon monoxide selectively at ultra low temperatures.

* * * * *